US009382860B2

(12) United States Patent
Klesse et al.

(10) Patent No.: US 9,382,860 B2
(45) Date of Patent: Jul. 5, 2016

(54) METHOD AND DEVICE FOR CONTROLLING A VALVE

(75) Inventors: Christoph Klesse, Wörth A.D.Donau (DE); Thomas Kraft, Obertraubling (DE); Hans Riepl, Hemau (DE); Tobias Ritsch, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 373 days.

(21) Appl. No.: 14/115,469

(22) PCT Filed: May 3, 2012

(86) PCT No.: PCT/EP2012/058151

§ 371 (c)(1),
(2), (4) Date: Mar. 26, 2014

(87) PCT Pub. No.: WO2012/150308

PCT Pub. Date: Nov. 8, 2012

(65) Prior Publication Data

US 2014/0196691 A1 Jul. 17, 2014

(30) Foreign Application Priority Data

May 4, 2011 (DE) ..... 10 2011 075 270

(51) Int. Cl.

| | |
|---|---|
| ***F02D 41/00*** | (2006.01) |
| ***F02D 41/20*** | (2006.01) |
| ***F02D 41/24*** | (2006.01) |
| ***F02D 41/40*** | (2006.01) |

(52) U.S. Cl.

CPC ..... *F02D 41/20* (2013.01); *F02D 41/2464* (2013.01); *F02D 41/401* (2013.01); *F02D 2041/2044* (2013.01)

(58) Field of Classification Search

CPC ... F02D 41/20; F02D 41/401; F02D 41/2464; F02D 2041/2044; F02D 2041/2058; F16K 31/06; F02M 59/366

USPC ..... 123/472, 478, 479, 480, 490, 90.11, 123/457, 458, 510, 511; 251/129.11

See application file for complete search history.

(56) References Cited

U.S. PATENT DOCUMENTS 6,000,379 A * 12/1999 Stockner ..... F02D 41/20 123/446
8,418,723 B2 * 4/2013 Tsuchiya ..... B62D 5/062 137/625.65

(Continued)

FOREIGN PATENT DOCUMENTS

DE 10148218 A1 4/2003 ..... F02D 41/08
DE 102007003211 A1 7/2008 ..... F02D 41/20

(Continued)

OTHER PUBLICATIONS

Chinese Office Action, Application No. 201280033196.3, 18 pages, Jul. 3, 2015.

(Continued)

*Primary Examiner* — Hai Huynh
(74) *Attorney, Agent, or Firm* — Slayden Gruber Beard PLLC

(57) ABSTRACT

A valve includes a spring having a spring force, an actuator having an actuator force that acts against the spring force, and a tappet that can be actuated by means of the actuator. The valve also includes a sealing element, which is or can be coupled to the tappet, and a sealing seat, such that the valve is closed when the sealing element lies against the sealing seat. A current having a specified curve, proceeding from an initial value of the current to a specified final value of the current, is applied during a specified time interval of the actuator after a closing phase of the valve for a normally open valve or after an opening phase for a normally closed valve. The initial value of the current is less than the final value.

16 Claims, 4 Drawing Sheets

(56) References Cited

U.S. PATENT DOCUMENTS

| | | | | |
|---|---|---|---|---|
| 8,960,157 | B2 * | 2/2015 | Kusakabe | F02D 41/20 123/472 |
| 2010/0193719 | A1 | 8/2010 | Bartel | 251/129.01 |

FOREIGN PATENT DOCUMENTS

| | | | | |
|---|---|---|---|---|
| DE | 102009000132 | A1 | 7/2010 | F02D 41/20 |
| EP | 1990526 | A2 | 11/2008 | F02D 41/20 |
| GB | 2331554 | A | 5/1999 | F02D 41/20 |
| JP | 2002115591 | A | 4/2002 | F02D 41/04 |
| WO | 2010/079027 | A1 | 7/2010 | F02D 41/20 |
| WO | 2012/150308 | A2 | 11/2012 | F02D 41/20 |

OTHER PUBLICATIONS

International Search Report and Written Opinion, Application No. PCT/EP2012/058151, 15 pages, Nov. 27, 2012.

* cited by examiner

METHOD AND DEVICE FOR CONTROLLING A VALVE

CROSS-REFERENCE TO RELATED APPLICATIONS

This application is a U.S. National Stage Application of International Application No. PCT/EP2012/058151 filed May 3, 2012, which designates the United States of America, and claims priority to DE Application No. 10 2011 075 270.6 filed May 4, 2011, the contents of which are hereby incorporated by reference in their entirety.

TECHNICAL FIELD

The invention relates to a method and a device for controlling a valve.

BACKGROUND

Valves used in high-pressure pumps for delivering fluid in common-rail injection systems of internal combustion engines of motor vehicles are subjected to high stresses, in particular if they are subjected to continuous loadings, such as in high-pressure pumps. Since high-pressure pumps are subjected to pressures of, for example, 2000 bar or more, high requirements are placed on the valves in such pumps. Noise can occur both when closing and when opening these valves.

SUMMARY

One embodiment provides a method for controlling a valve that comprises a spring having a spring force, an actuator having an actuator force acting against the spring force, and a tappet which can be actuated by means of the actuator, a sealing element, which is or can be coupled to the tappet, and a sealing seat, so that the valve is closed when the sealing element bears on the sealing seat, in which following a closing phase of the valve in the case of a normally open valve, or following an opening phase in the case of a normally closed valve, a current having a predefined course is impressed on the actuator during a predefined time interval, starting from an initial value of the current to a predefined final value of the current, wherein the initial value of the current is lower than the final value.

In a further embodiment, a beginning of a valve opening of the normally open valve is detected and, as soon as the beginning of the valve opening is detected, a start of the time interval is predefined based on the detected beginning of the valve opening.

In a further embodiment, a beginning of a valve closure of a normally closed valve is detected and, as soon as the beginning of the valve closure is detected, the start of the time interval is predefined based on the detected beginning of the valve closure.

In a further embodiment, a duration of the time interval is predefined based on a coupling between the tappet and the sealing element.

In a further embodiment, the valve is arranged in an inlet area of a pump and the tappet is coupled directly to the sealing element, and the duration is equal to approximately 15% to 20% of a time period of a delivery phase of the pump.

In a further embodiment, the valve is arranged in the inlet area of the pump and the tappet can be coupled to the sealing element and the duration is equal to approximately 50% of the time period of the delivery phase of the pump.

In a further embodiment, the final value of the current is predefined based on the spring force of the spring.

In a further embodiment, the course of the current is predefined in the form of steps.

Another embodiment provides a device for controlling a valve that comprises a spring having a spring force, an actuator having an actuator force that acts against the spring force, and a tappet which can be actuated by means of the actuator, a sealing element, which is or can be coupled to the tappet, and a sealing seat, so that the valve is closed when the sealing element bears on the sealing seat, wherein the device is designed, following a closing phase of the valve in the case of a normally open valve, or following an opening phase in the case of a normally closed valve, to impress a current having a predefined course on the actuator during a predefined time interval, starting from an initial value of the current to a predefined final value of the current, wherein the initial value of the current is lower than the final value.

BRIEF DESCRIPTION OF THE DRAWINGS

Example embodiments of the invention are explained in more detail below with reference to the drawings, in which.

DETAILED DESCRIPTION

Figure 1:
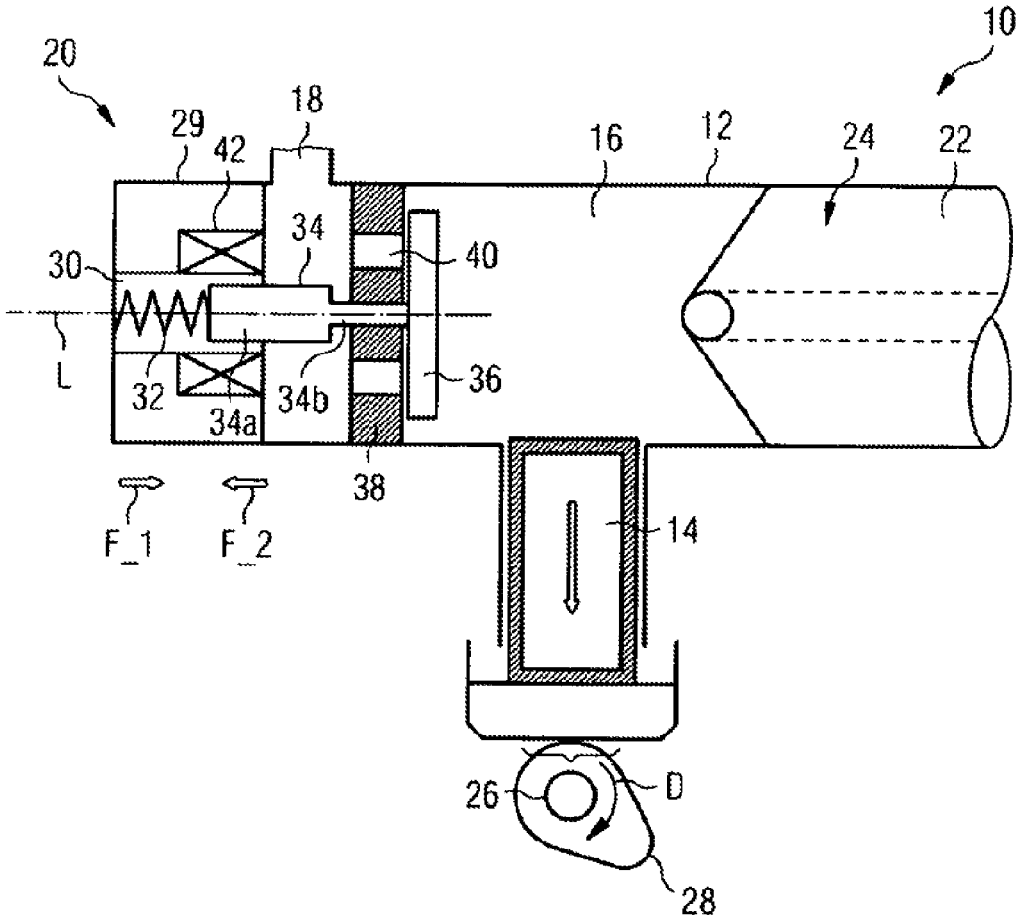
FIG. 1 shows a pump having a first exemplary embodiment of a valve in a longitudinal section.

Embodiments of the present invention provide a method and a device for controlling a valve which permits precise and economical operation of the valve.

Some embodiments provide a method and a corresponding device for controlling a valve. The valve comprises a spring having a spring force, an actuator having an actuator force acting against the spring force, and a tappet which can be actuated by means of the actuator. Furthermore, the valve comprises a sealing element, which is or can be coupled to the tappet, and a sealing seat, so that the valve is closed when the sealing element bears on the sealing seat. Following a closing phase of the valve in the case of a normally open valve, or following an opening phase in the case of a normally closed valve, a current having a predefined course is impressed on the actuator during a predefined time interval, starting from an initial value of the current to a predefined final value of the current. Here, the initial value of the current is lower than the final value.

This has the advantage that the valve can be opened and closed, respectively, slowly in such a way that the development of noise from the valve can be kept low and nevertheless reliable and sufficiently quick opening and closing of the valve can be achieved. Furthermore, wear of the valve can be kept low. Moreover, economical implementation of the valve is possible. The actuator thus has two functions. Firstly, the actuator has the function of a valve actuating element. Furthermore, the actuator permits damping of the impingement of the tappet on the sealing seat and/or on the sealing element, and/or the actuator permits damping of the impingement of the sealing element on an end position limiting means, for example on a valve housing wall. The actuator may have an electromagnet. During the time interval in which the actuator is activated in order to brake the tappet, the tappet can be moved at least partly out of a magnetic field of the actuator, so that the actuator force that acts on the tappet decreases, the further the tappet is moved out of the magnetic field. Advantageously, by means of the rising course of the current from the initial value to the final value, it is possible to compensate for this effect and the actuator force can be kept approximately constant.

In one embodiment, a beginning of a valve opening of the normally open valve is detected and, as soon as the beginning of the valve opening is detected, a start of the time interval is predefined based on the detected beginning of the valve opening. The beginning of the valve opening can be detected by means of registering a movement of the tappet along a longitudinal axis of the tappet. For example, the time interval can be started as soon as it is detected that, starting from an initial position of the tappet, in which the tappet permits the valve to be opened or the valve is closed, the tappet moves in the direction of an end position of the tappet, in which the tappet does not permit the valve to be closed/or the valve is open. Furthermore, the start of the time interval can be predefined based on a valve type and/or based on at least one operating parameter of the valve.

In a further embodiment, a beginning of a valve closure of the normally closed valve is detected and, as soon as the beginning of the valve closure is detected, the start of the time interval is predefined based on the detected beginning of the valve closure. For example, the time interval can be started as soon as it is detected that, starting from the initial position of the tappet, in which the tappet permits the valve to be closed or the valve is open, the tappet moves in the direction of an end position of the tappet, in which the tappet does not permit the valve to be opened or the valve is closed.

In a further embodiment, a duration of the time interval is predefined based on a coupling between the tappet and the sealing element. This permits a braking action of the tappet, effected by the actuator force, and/or of the sealing element during the opening operation or closing operation of the valve to be matched to a valve type and/or an area of application.

In a further embodiment, the valve is arranged in an inlet area of a pump and the tappet is coupled directly to the sealing element. Here, the duration of the time interval is equal to approximately 15% to 20% of a time period of a delivery phase of the pump.

In a further embodiment, the valve is arranged in the inlet area of the pump and the tappet can be coupled to the sealing element. Here, the duration of the time interval is equal to approximately 50% of the time period of the delivery phase of the pump.

In a further embodiment, the final value of the current is predefined based on the spring force of the spring. This advantageously permits the final value of the current to be predefined such that the valve can be opened and closed sufficiently rapidly and it is possible to ensure that the valve opens and closes.

In a further embodiment, the course of the current is predefined in the form of steps. The course of the current can comprise a plurality of chronologically following sections, each of the sections having a value of the current with a substantially constant course of the current and the section following a preceding section chronologically having a greater value of the current than the preceding section. This has the advantage that the course of the current has a simple and easily producible form.

FIG. 1 shows a pump 10 having a pump housing 12. The pump 10 is in particular constructed as a high-pressure pump, e.g., as a radial piston pump. In the pump housing 12, a pump piston 14 is mounted such that it can move. In the pump housing 12, at one end of the pump piston 14, there is a pressure chamber 16. In order to be able to fill the pressure chamber 16 with fluid, said chamber has a feed line 18, in which a valve 20 may be arranged, formed as an inlet valve. The valve 20 formed as an inlet valve may be formed as a digitally controlled valve. The valve 20 makes it easier to fill the pressure chamber 16 and, during filling, prevents the fluid from flowing back out of the feed line 18. The pressure chamber 16 further has a discharge line 22, in which there is arranged a further valve 24, formed as an outlet valve. Fluid can therefore be expelled from the pressure chamber 16.

The pump 10 further has a drive shaft 26, which is operatively connected to an eccentric ring 28 and can be rotated in the clockwise direction in a direction of rotation D. Instead of the eccentric ring 28, a camshaft can also be used. Alternatively, the pump 10 can also be designed as a crank drive pump.

FIG. 1 shows a first exemplary embodiment of the valve 20. The valve 20 comprises a valve housing 29 which has a cut-out 30. Arranged in the cut-out 30 are a spring 32, a tappet 34 and a sealing element 36. The spring 32 preloads the sealing element 36 via the tappet 34, in that it is supported on a wall of the cut-out 30. The sealing element 36 and the tappet 34 are coupled directly mechanically. The tappet 34 comprises a first cylindrical part 34*a* and a second cylindrical part 34*b*, the first part 34*a* having a greater diameter than the second part 34*b*.

Also located in the cut-out 30 is a sealing seat 38 which is arranged to be fixed with respect to the valve housing 29 and which has passage cut-outs 40. Fluid is able to flow via the passage cut-outs 40 when the sealing element 36 is not bearing on the sealing seat 38.

The valve 20 also has an actuator 42, which in particular is formed as a magnetic coil. The first part 34*a* of the tappet 34 is at least partly arranged inside the actuator 42 and can be actuated by the actuator 42.

Both when opening and when closing the valve 20, noise can occur on the valve 20 because of mechanical and hydraulic causes. The tappet 34 is moved toward the valve seat 38 by the spring force F_1 of the spring 32. When the sealing seat 38 and the tappet 34, in particular the first part 34*a* of the tappet 34, meet each other, noise can occur.

Activating the actuator 42, for example shortly before the tappet 34 has reached its end position, in which the valve 20 is opened to the maximum and the first part 34*a* of the tappet 34 is bearing on the sealing seat 38, makes it possible for the tappet 34 to be braked and for the impingement of the tappet 34 on the sealing seat 38 to be damped.

Figure 2:
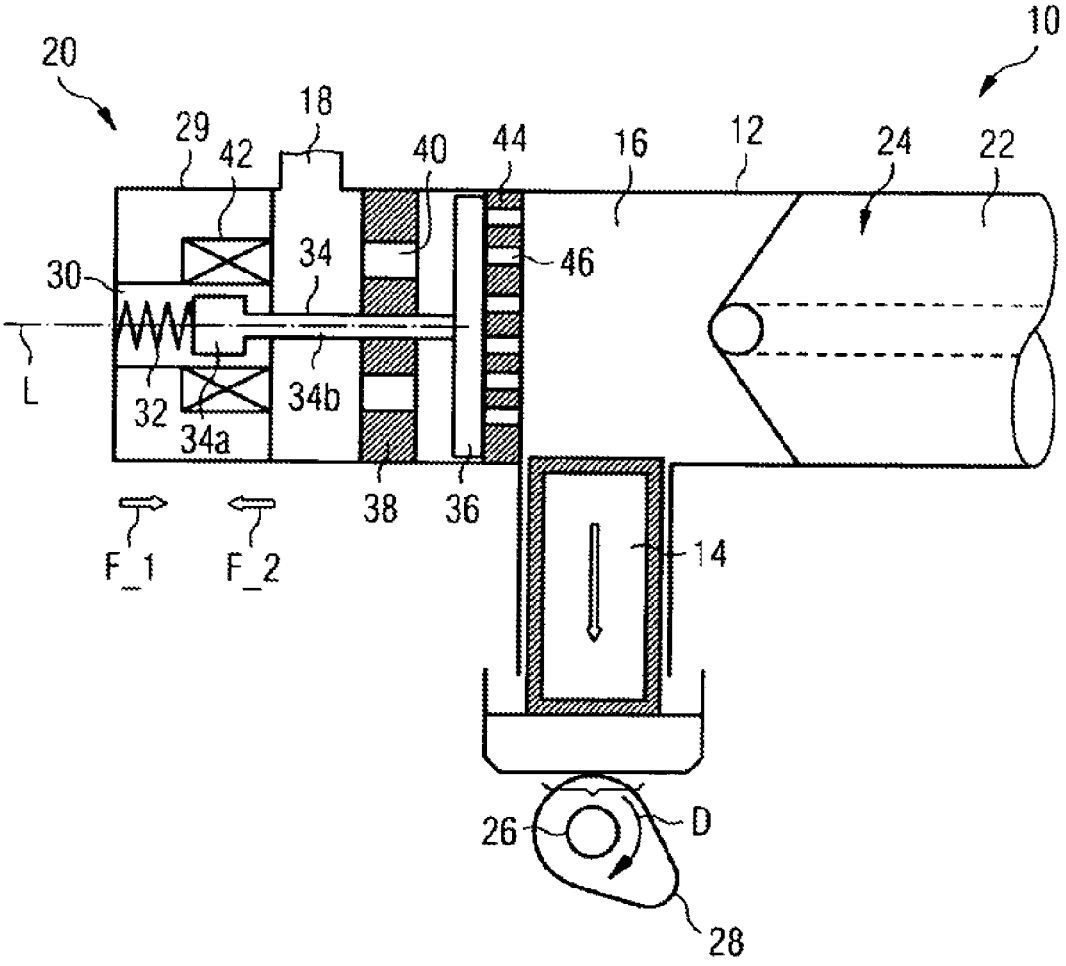
FIG. 2 shows the pump having a second exemplary embodiment of the valve in a longitudinal section.

FIG. 2 shows a second exemplary embodiment of the valve 20. As compared with the first exemplary embodiment, the tappet 34 and the sealing element 36 are not coupled directly mechanically. Furthermore, the cut-out has an end position limiting element 44, which is arranged and designed to limit an axial movement of the tappet 34 and/or of the sealing element 36 in the direction of the pressure chamber 16. The end position limiting element 44 has further cut-outs 46, via which fluid can flow into the pressure chamber 16.

Both when opening and when closing the valve 20, noise can occur on the valve 20 because of mechanical and hydraulic causes. When opening the valve 20, in a first step the sealing element 36 strikes the end position limiting element 44, which means that a first noise can occur. The tappet 34 is then moved toward the sealing element 36 by the spring force F_1 of the spring 32. When the sealing element 36 and the tappet 34 meet each other, a further noise can occur. Activating the actuator 42, for example shortly before the tappet 34 strikes the sealing element 36, makes it possible for the tappet 34 to be braked and for the impingement of the tappet 34 on the sealing element 36 to be damped.

Figure 3A:
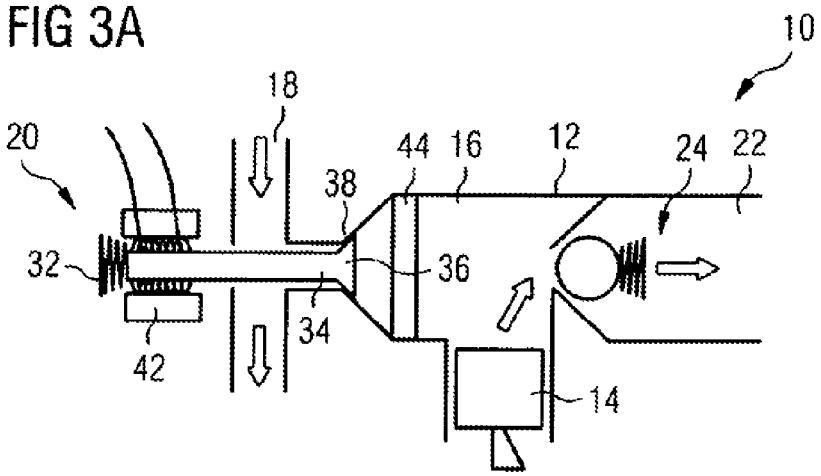
FIGS. 3A-3C show a third exemplary embodiment of the valve in three operating states.

FIG. 3A shows a third exemplary embodiment of the valve 20. The valve 20 has a valve housing 29 which has a cut-out 30. Arranged in the cut-outs 30 are a spring 32, a tappet 34 and a sealing element 36. The spring 32 preloads the sealing element 36 via the tappet 34, in that it is supported on a wall of the cut-out 30. The sealing element 36 and the tappet 34 are coupled directly mechanically. The sealing element 36 and the tappet 34 may be formed in one piece. The valve housing 29 comprises a sealing seat 38. The sealing seat 38 and the sealing element 36 are conical, so that when the sealing element 36 is bearing on the sealing seat 38, the valve 20 is closed. Furthermore, the valve 20 comprises the end position limiting element 44, which is arranged and designed to limit an axial movement of the tappet 34 and of the sealing element 36 in the direction of the pressure chamber 16. The end position limiting element 44 has further cut-outs 46, via which fluid can flow into the pressure chamber 16.

When opening the valve 20, the sealing element 36 strikes the end position limiting element 44, which means that a noise can arise. If the tappet 34 and the sealing element 36 are together formed in one piece, the noise can be formed very clearly as a result of the common mass of the tappet 34 and sealing element 36.

Figure 3B:
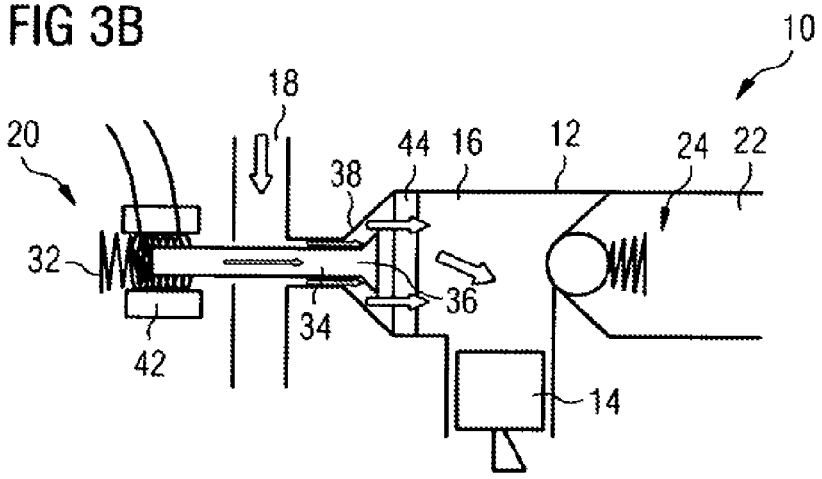
Figure 3C:
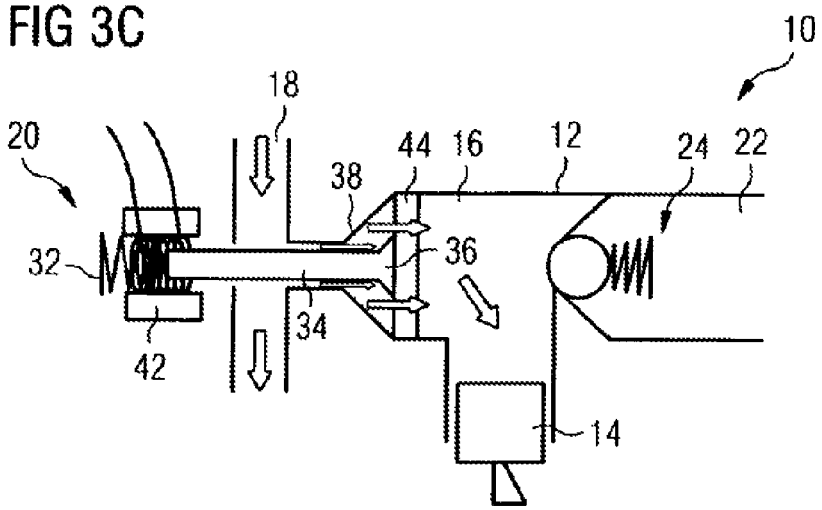

In the following text, controlling the valve for a normally open valve 20 will be explained in detail (FIGS. 3A to 3C). It is clear that this can be used in a corresponding way to a normally closed valve.

During the delivery phase (FIG. 3A) of the pump 10, by means of a rotational movement of the drive shaft 26 in a direction of rotation D, the pump piston 40 is moved away from the drive shaft 26 by the eccentric ring 28 and, in the process, compresses the fluid in the pressure chamber 16. At a predefined time, the valve 20 is closed by applying a current to the actuator 42, which means that an actuator force F_2 acting against the spring force F_1 can act on the tappet 34. As a result of the movement of the tappet 34 in the direction of the actuator force F_2 and the pressure relationships prevailing upstream and downstream of the valve 20, the sealing element 36 can bear on the sealing seat 38 and a flow of fluid from the feed line 18 into the pressure chamber 16 is prevented. The compressed fluid in the pressure chamber 16 can then be expelled from the pump 10 completely via the further valve 24 formed as an outlet valve. At the end of the delivery phase, the pump piston 14 has reached its top dead center point.

If the pump 10 is a high-pressure fuel pump of an injection system of an internal combustion engine, then the fuel pressurized with a high pressure can reach a fluid reservoir formed as a high-pressure fuel reservoir, what is known as the common rail.

At the beginning of a suction phase of the pump 10 (FIG. 3B), the pump piston 14 is moved toward the drive shaft 16 by means of the eccentric ring 28 as a result of the further rotational movement of the drive shaft 26 in the direction of rotation D. Here, the valve 20 begins to open on account of the spring force F_1 of the spring 32 and the pressure difference upstream and downstream of the valve 20.

Following the closing phase of the valve 20 and after the delivery phase of the pump 10, during a predefined time interval, a current with a predefined course is impressed on the actuator 42, starting from an initial value I_0 of the current up to a predefined final value I_END of the current, the initial value I_0 of the current being smaller than the final value I_END. The time interval can, for example, start immediately after the end of the delivery phase or at a later time, in which the tappet 34 has already moved and/or the sealing element 36 has already lifted partly off the sealing seat 38.

For example, a beginning of a valve opening of the valve 20 can be detected and, as soon as the beginning of the valve opening is detected, a start of the time interval can be predefined based on the detected beginning of the valve opening. The start can be made chronologically immediately after the detection of the beginning of the valve opening or after a short time interval after the detection of the beginning. The short time period can, for example, be predefined based on an average valve opening time of the valve 20.

The actuator force F_2 produced by the actuator 42 that has been energized acts against the spring force F_1 and pressure difference, so that the tappet 34 and/or the sealing element 36 is/are braked in their movement. Thus, the movement of the tappet 34 toward the sealing seat 38 (FIG. 1) and/or the movement of the tappet 34 toward the sealing element 36 (FIG. 2) or the movement of the tappet 34 and of the sealing element 36 toward the end position limiting element 44 (FIG. 3B) is/are braked. As a result of the reduced speed, impingement noise can be reduced substantially. As a result of the slow movement of the tappet 34, the development of noise of the valve 20 can be kept very small and, nevertheless, the valve 20 can be opened and reliably and sufficiently quickly. Furthermore, as a result of the slow movement of the tappet 34, the wear of the valve 20 can be kept low.

Figure 4:
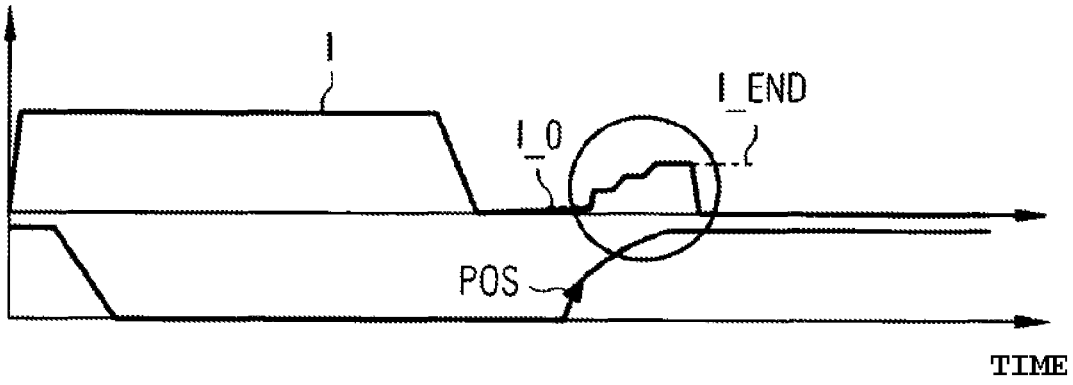
FIG. 4 shows a current course and a course over time of a position of a tappet.

The predefined rising course of the current starting from an initial value I_0 of the current up to a predefined final value I_END of the current makes it possible to compensate for an at least partial movement of the tappet out of a magnetic field of the actuator 42, and thus to keep the actuator force F_2 approximately constant. The course of the current can, for example, be predefined in the form of steps. FIG. 4 shows a schematic view of the course of the current and a course of the position POS of the tappet 34 over time, as based on an initial position of the tappet 34, in which the normally open valve 20 is closed.

A duration of the time interval can be predefined, for example, based on a coupling between the tappet 34 and the sealing element 36. For example, if the tappet 34 is coupled directly to the sealing element 36, the duration of the time interval can be equal to approximately 15% to 20% of a time period of the delivery phase of the pump 10.

If the tappet 34 and the sealing element 36 are not coupled directly mechanically but are arranged such that they can be coupled, the duration of the time interval can be equal to approximately 50% of the time period of the delivery phase of the pump 10.

The final value I_END of the current can be predefined, for example, based on the spring force F_1 of the spring 32. The initial value I_0 of the current can, for example, be zero.

During a continuation of the suction phase (FIG. 3C) of the pump 10, by means of continuing the further rotational movement of the drive shaft 26 in the direction of rotation D, the pump piston 14 is moved further toward the drive shaft 26 by means of the eccentric ring 28. The valve 20 is opened. The pressure chamber 16 is then filled with fluid.

What is claimed is:

1. A method for controlling a valve that comprises a spring having a spring force, an actuator having an actuator force acting against the spring force, and a tappet which can be actuated by means of the actuator, a sealing element, which is or can be coupled to the tappet, and a sealing seat, such that the valve is closed when the sealing element bears on the sealing seat, the method comprising:

following a closing phase of the valve in the case of a normally open valve, or following an opening phase in the case of a normally closed valve:

applying a current having a predefined course to the actuator during a predefined time interval, starting from an initial value of the current to a predefined final value of the current, wherein the applied current generates an actuator force opposing without overcoming the force applied by the spring, wherein the initial value of the current is lower than the final value.

2. The method of claim 1, wherein the valve is a normally open valve, the method comprising:

detecting a beginning of a valve opening of the normally open valve, and starting the time interval upon detecting the beginning of the valve opening.

3. The method of claim 1, wherein the valve is a normally closed valve, the method comprising:

detecting a beginning of a valve closure of the normally closed valve, and starting the time interval upon detecting the beginning of the valve closure.

4. The method of claim 1, wherein a duration of the time interval is predefined based on a coupling between the tappet and the sealing element.

5. The method of claim 4, wherein the valve is arranged in an inlet area of a pump and the tappet is coupled directly to the sealing element, and wherein the duration is equal to approximately 15% to 20% of a time period of a delivery phase of the pump.

6. The method of claim 4, wherein the valve is arranged in the inlet area of the pump and the tappet is configured for coupling to the sealing element, and wherein the duration is equal to approximately 50% of the time period of the delivery phase of the pump.

7. The method of claim 1, wherein the final value of the current is predefined based on the spring force of the spring.

8. The method of claim 1, wherein the course of the current is predefined in the form of steps.

9. A device for controlling a valve, the device comprising:

a spring having a spring force, an actuator having an actuator force that acts against the spring force, a tappet which can be actuated by means of the actuator, a sealing element, which is or can be coupled to the tappet, and a sealing seat, such that the valve is closed when the sealing element bears on the sealing seat, wherein the device is configured to, following a closing phase of the valve in the case of a normally open valve, or following an opening phase in the case of a normally closed valve:

apply a current having a predefined course to the actuator during a predefined time interval, starting from an initial value of the current to a predefined final value of the current, wherein the applied current generates an actuator force opposing without overcoming the force applied by the spring, wherein the initial value of the current is lower than the final value.

10. The device of claim 9, wherein the valve is a normally open valve, and wherein the device is configured to:

detect a beginning of a valve opening of the normally open valve, and start the time interval upon detecting the beginning of the valve opening.

11. The device of claim 9, wherein the valve is a normally closed valve, and wherein the device is configured to:

detect a beginning of a valve closure of the normally closed valve, and start the time interval upon detecting the beginning of the valve closure.

12. The device of claim 9, wherein a duration of the time interval is predefined based on a coupling between the tappet and the sealing element.

13. The device of claim 12, wherein the valve is arranged in an inlet area of a pump and the tappet is coupled directly to the sealing element, and wherein the duration is equal to approximately 15% to 20% of a time period of a delivery phase of the pump.

14. The device of claim 12, wherein the valve is arranged in the inlet area of the pump and the tappet is configured for coupling to the sealing element, and wherein the duration is equal to approximately 50% of the time period of the delivery phase of the pump.

15. The device of claim 9, wherein the final value of the current is predefined based on the spring force of the spring.

16. The device of claim 9, wherein the course of the current is predefined in the form of steps.

* * * * *